US005960987A

United States Patent [19]

Solland et al.

[11] Patent Number: 5,960,987

[45] Date of Patent: Oct. 5, 1999

[54] SELF SEALING DRINKING DISPENSER

[75] Inventors: Kurt Solland, Manhattan Beach; Glen H. Tobias, Los Angeles, both of Calif.

[73] Assignee: Flip Cup Company, LLC, Los Angeles, Calif.

[21] Appl. No.: 09/061,353

[22] Filed: Apr. 16, 1998

[51] Int. Cl.[6] ..... B65D 3/20; B65D 47/08; B31B 1/72

[52] U.S. Cl. ..... 220/834; 220/839; 220/717; 222/528; 222/556; 222/572; 229/404

[58] Field of Search ..... 220/703, 704, 220/716, 717, 825, 833, 834, 835, 839, 837, 838; 222/528, 535, 572, 462, 556; 229/404, 400, 125, 125.42

[56] References Cited

U.S. PATENT DOCUMENTS

| | | | |
|---|---|---|---|
| 2,016,964 | 10/1935 | Huffman | 222/528 |
| 2,646,200 | 7/1953 | Atkins | 220/703 X |
| 2,812,121 | 11/1957 | Sheets | 222/528 |
| 3,047,179 | 7/1962 | Madej | 222/528 |
| 3,315,866 | 4/1967 | Kersh et al. | 229/125.42 |
| 3,334,797 | 8/1967 | Latham et al. | 220/838 X |
| 4,216,880 | 8/1980 | Drelichowski | 222/528 X |
| 4,356,951 | 11/1982 | Sharp | 229/125.42 |
| 4,572,413 | 2/1986 | Vogt | 222/528 |
| 4,620,665 | 11/1986 | McSherry | 229/125 |
| 4,886,206 | 12/1989 | Martinez | 229/400 X |
| 5,645,191 | 7/1997 | Neville | 220/717 |

*Primary Examiner*—Stephen K. Cronin
*Assistant Examiner*—Nathan Newhouse
*Attorney, Agent, or Firm*—Harris F. Brotman

[57] ABSTRACT

A container having an integral lid hinged about the wall of the container to selectively close and seal the same on demand. Integral walls extend from the bottom portion of the device to form the container, the top portion terminates in a rim and a sealing ridge. Integral to one of the walls of the container is a lid formed by a crease within one of the walls, which crease defines the bottom end of the lid. The lid's top end is matched to the shape of the top portion of the container for conforming and locking therewith in the closed position, the lid extending above the top portion of the cup, forming a spout and a lid, at least one aperture formed in the lid to facilitate dispensing of the contents from the container when the lid is in the closed position.

16 Claims, 5 Drawing Sheets

FIG. 8
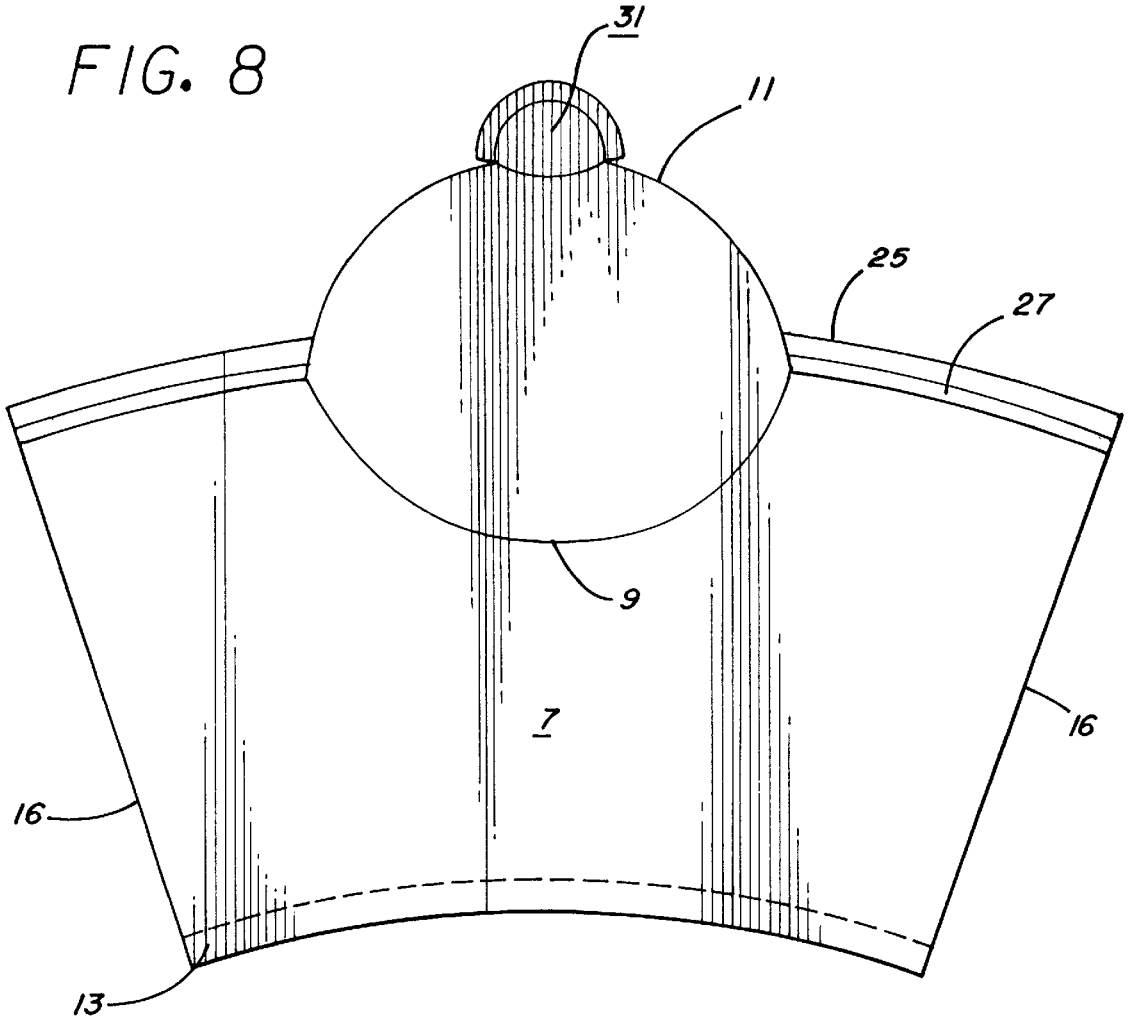
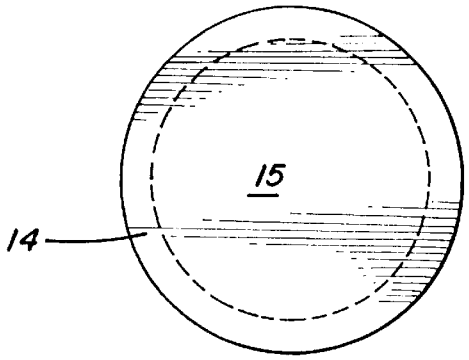
FIG. 9

SELF SEALING DRINKING DISPENSER

FIELD OF THE INVENTION

The present invention relates to a container, and more particularly to a self-sealing portable container having an integrally hinged lid that is in part defined by a crease formed in the continuous annular walls of the container.

BACKGROUND OF THE INVENTION

Today society has come to appreciate the benefits of disposable items that make their daily tasks simpler and more enjoyable. Examples of such items include disposable eating utensils and paper plates. These disposable items are discarded or recycled after a single or limited use. Another common disposable item is drinking cups and/or general-purpose containers (which terms hereafter shall be interchangeably referred to as "containers" or "cups" ). After a single use, the user discards the cup. These cups are often used at coffee machines, cafeterias and fast food restaurants.

One of the inherent problems with disposable containers is that they are often formed of multiple parts. For example, a drinking cup may be designed to cooperate with a tailored lid to prevent spilling and contamination of the liquid and to maintain the temperature of the liquid such as hot coffee or a cold beverage. Another problem is that a detachable lid requires the user or the shopkeeper to maintain a stock of cups and matching lids, wherein each different cup requires a different lid. This requires extra storage or display space, unnecessary expense and organization. Another significant problem is that the user must fit the lid over the container. This often results in the spilling of the contents. In some instances, where the contents are very warm or have staining characteristics, this is particularly undesirable. In other instances, the placement of the lid over the container often deforms the lid, the cup or both and fails to serve its essential purpose of sealing the container.

In the prior art, self-sealing containers require assembly or have inherent non-symmetric characteristics. One such container is described in the U.S. Pat. No. 4,135,512. The device of this patent describes a dispenser having a combination of semicylindrical and flat walls attached to an integral flat lid hinged to its flat wall. The lid further employs means to hold and dispense medication. This lid extends in a downward slope to lock in a closed position between two ridges formed within the flat wall and creates an acute angle for retaining the medication within the container. This allows medical personnel to place the medication atop of the lid, which lid extends in a downward slope and retains the medication in the cavity formed by the lid and the wall. The cup and the medication are thereafter delivered to the patient without spilling its contents and without dropping the medication held atop of the lid. The patient then tilts the cup to his/her mouth to dispense the liquid therein and at the same time, through force of gravity, also delivers the medication to his/her mouth.

U.S. Pat. No. 5,358,175 describes a container formed of a foldable sheet material, which container requires assembly and interconnection of flaps and a tongue-slot combination. U.S. Pat. No. 4,850,528 discloses a self-locking and self-closing container creating a spring action pleated top. U.S. Pat. No. 5,676,306 discloses a container having a sealing top formed by a series of crease lines folding inwardly and forming a series of rectangles, each having a diagonal comer portion to form a closure panel. U.S. Pat. No. 4,730,766 describes a container having a gable end that includes sealing flaps that are heat sealed or bonded to one another.

U.S. Pat. No. 3,768,720 describes a polygonal prism container erectable from a blank having a closable top comprising a plurality of interlocking flaps. U.S. Pat. Nos. 2,091,291 and 3,549,081 describe a constructable, polygonal container having a series of interlocking flaps that cooperate to close the top and bottom openings of the container when folded about the formed seams and mutually interlocked. U.S. Pat. No. 3,905,539 discloses a container comprising a tube having a permanently sealed bottom end and tapering to a two dimensional sealable top end. U.S. Pat. No. 4,712,725 describes a container for dispensing foods and storage of articles having a plurality of triangular sections foldable to define a substantially cylindrical container having a self-sealing top defined by a plurality of interlocked flaps. U.S. Pat. No. 3,617,311 discloses a sealed paper cup having a circular top portion extending to a bottom portion that is tapered to a point; for mixing a beverage consisting of water added to a resident dry concentrate.

The aforementioned devices of the prior art require assembly by the user and/or require interlocking of multiple flaps defined by their prearranged geometry and/or crease lines. The device of the present invention does not have these limitations. It consists of a symmetrical container having an integrated lid/spout (the terms "lid" and "spout" are used interchangeably throughout this specification) portion defined by a single crease in its wall. The lid doubles as an integral spout cooperative with the ridge of the device for maintaining a sealed position when biased under its rim. The device of the present invention is integral, assembly free and is easily and efficiently stored and stackable with its lid in the upright position. It provides single hand sealing operability and reliability for the convenience of its user.

SUMMARY OF THE INVENTION

The device of the present invention is a container having an integral lid hinged about the wall of the container to selectively close and seal the same on demand. Integral walls extend from the bottom portion of the device to form the container. The container normally rests on the bottom portion and the top portion terminates in a rim and a sealing ridge. Integral to one of the walls of the device is a lid formed by a crease within one of the walls, which crease defines the bottom end of the lid. The lid's top end is arcuate (matched to the shape of the top portion of the device for conforming and locking therewith in the closed position) and it extends above the top portion of the cup, forming a spout and a lid. When biased by the user to its closed position, the lid is hinged about the crease and seals the cup along its "ridge" or "channel" (which terms, for purposes of this disclosure, are given equal meaning), wherein the arcuate distal end of the lid conforms to the shape of the top portion of the cup and its formed ridge and is kept in a locked position by said ridge. In another embodiment of the invention, the lid employs at least one aperture terminating in a lip conducive to accepting a drinking straw therethrough or for limited distribution of the contents. The aperture and its lip also serve the utility of a sipping means for drinking cold beverages or hot beverages such as tea, coffee, hot chocolate or soup.

It is therefore the object of the present invention to provide a container having an integral lid therewith for closing the container on demand. It is the object of the present invention to eliminate the need of having multiple parts to form a sealed container. It is the object of the present invention to provide a container having at least one aperture for dispensing of its contents. It is the object of the present invention to provide a container that is efficiently stackable for purposes of shipping, display, dispensing and storage. It is the object of the present invention to provide a container having an integral lid, which lid is hinged along one of the walls of the container and wherein the hinge comprises a crease formed in one of the walls of the container. It is the object of the present invention to provide a container having a ridge formed atop of the container for receiving and locking the lid therewith until such time as the container is volitionally and sufficiently deformed to dismiss the top potion of the lid from the ridge, at which time the lid is placed in its upright position to facilitate the dispensing of the contents from the container. It is the object of the present invention to employ at least one aperture atop of the lid thereby forming an opening from which the user sips or an opening for placement of a drinking straw into the container, when the lid is in its closed position, or to facilitate the dispensing of the contents of the container when the lid is in its upright position. It is the object of the present invention to provide at least one perforated opening formed about the lid of the device to allow the user to selectively create at least one aperture. It is an object of the present invention to provide at least one perforated opening for placement of a tool therein, such as a drinking straw, spoon or a fork. It is the object of the present invention to provide a crease-hinge for reciprocal movement of the lid from its closed position, in action with the ridge of the container, to an open position, to facilitate the dispensing or filling of the contents to and from the container. It is the object of the present invention to provide a shaped, distal end of the lid that substantially matches the geometry of the top portion of the container and its ridge to lock therewith. It is the object of this invention to construct the container from materials that are deformable and preferably having resilient or elastic qualities. These qualities allow the device of the present invention to bring the lid to its closed position about the crease/hinge and to lock the arcuate top of the lid with the ridge of the top portion of the container. It is the object of the present invention to maximize the storage volume defined by its walls and the lid. It is the object of the present invention to construct the container from readily available materials including without limitation materials such as plastic, plastic derivatives such as foam and polypropylene, wood and/or paper products. It is the object of the present invention to disclose an invention equally applicable to long term and disposable use. It is the object of the present invention to disclose a product that is easily and/or economically manufacturable. It is the object of the present invention to disclose a device that enhances the safety of dispensing and transporting materials that are warm, cold and/or having staining characteristics. It is the object of the present invention to disclose a device having added safety characteristics such that the contents placed in the container are more likely to be contained within the device without unwanted spilling or loss.

DRAWINGS

FIG. 8 is a plan view of the diecut sheet of material for forming the device of the present invention.

FIG. 9 is a plan view of the diecut sheet of material for forming the floor of the device of the present invention.

DETAILED DESCRIPTION OF THE PREFERRED EMBODIMENT

Figure 1:
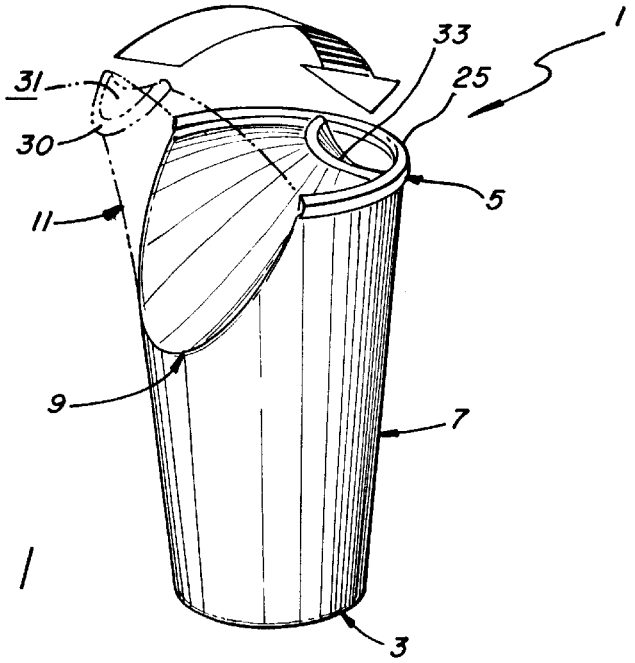
FIG. 1 illustrates the perspective view of the device of the present invention.

The preferred embodiment of the device of the present invention 1 is shown in its perspective view in FIG. 1. Device 1 consists of a bottom portion 3 and a top portion 5, formed at the diametrically opposed distal ends of device 1. An endless, continuous body 7 joins top and bottom portions 3 and 5 and forms the walls of device 1. Toward the top of device 1, along its body 7, a crease 9 is formed. Crease 9 serves the function of a hinge allowing a lid 11 to pivotally and reciprocally move from its open, convex shaped position, shown in FIG. 2, to its closed, concave shaped position, shown in FIG. 3. Lid 11 is integral to body 7. In its closed position, lid 11 functions to close the container 1 to prevent unwanted spilling and/or contamination and at the same time it preserves the contents and/or maintains its temperature. Accordingly, device 1 is particularly useful as a container for hot or cold liquids/beverages and it allows the user to close lid 11 to prevent the beverage from spilling while maintaining the desired temperature of the beverage and to consume the contents from the aperture by sipping or with the use of a straw or other utensil inserted into the aperture. In its open position, lid 11 functions as a spout, guiding the contents to the desired destination such as another container or the user's mouth. Accordingly, in its preferred embodiment, the user can use device 1 as a drinking cup having an integral lid 11.

More particularly, device 1 and its body 7 employ a generally annular crossection and will be discussed as such throughout this specification. However, rectangular or polygonal configurations are equally plausible for esthetic or functional purposes. The annular shape is conducive to the user's grip and transport of device 1 in his/her hand and/or common receptacles, now commonly placed in theaters and vehicles. In the preferred embodiment, device 1 is gradually tapered from its top portion 5 along its body 7 to its bottom portion 3. This allows efficient nesting of multiple units for storage and transport and it also provides for structural strength during transit, since the force along body 7 will be absorbed by a plurality of nested containers 1.

Figure 2:
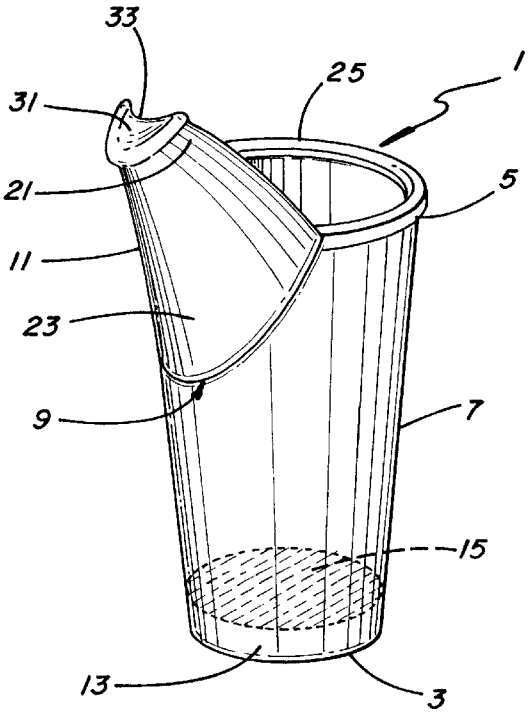
FIG. 2 illustrates a perspective view of the device of the present invention with its lid portion in the open position.

Bottom portion 3 generally serves as a stand for device 1 and is illustrated in detail in FIG. 2. In one preferred embodiment, it comprises a stand 13 formed by a 180 degree fold of the material forming body 7 and it is attached, by means of a glue or press, to the inside thereof. Accordingly, stand 13 gains structural strength by its double wall construction. Moreover, in the preferred embodiment, a floor 15, matching the crossection of the shape defined by body 7 and dimensioned to the circumference defined by stand 13, is attached perpendicular to stand 13. Floor 15 is a section matching the shape of stand 13, as defined by body 7, having a junction section 14 that is glued or attached along its dotted lines, shown in FIG. 9, with the folds of material comprising stand 13, thereby providing a sealed environment for the contents placed in device 1. This method of constructing the device, illustrated in FIGS. 8 and 9, is not limiting, as the device may be constructed by any suitable method. Other embodiments may provide other means for attaching or forming floor 15 to bottom portion 3, equally well reaching the objective of providing a sealed environment for containment of materials placed in device 1. As shown in FIG. 8, bonding the peripheral edges 16 to each other forms body 7. These methods, include, without limitation, heat press bonding, glue bonding the folds or any suitable method of bonding to form stand 13 and body 7 of device 1.

Extending from bottom portion 3 is the body 7. Body 7, as well as the remainder of device 1, is preferably formed of a material having a defined shape and strength, having deforming characteristics and preferably having some elastic or resilient, deforming characteristics. Some of the materials having such properties include, without limitation, plastics such as styrofoam, polypropylene, wood and paperboard or cardboard. Device 1 may be constructed of at least one or in combination of these materials. Body 7 defines the continuous, endless walls of device 1 and in part defines the volume of material placed in device 1. The greater the circumference of body 7, the more volume device 1 can hold. Accordingly, depending on the application of device 1, the circumference of body 7 is varied. In the application involving the use of device 1 as a drinking utensil, the circumference of body 7 is dimensioned to accommodate the handgrip of an average human hand (child or adult) and its height is dimensioned to the desired volume of the container.

Figure 3:
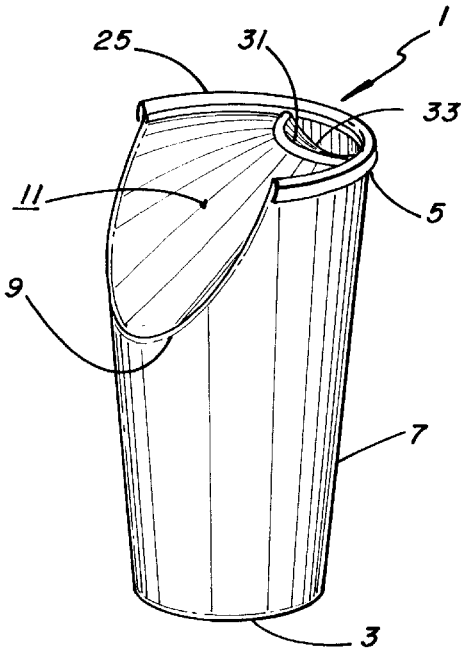
FIG. 3 illustrates a perspective view of the device of the present invention with its lid portion in the closed position.
Figure 4:
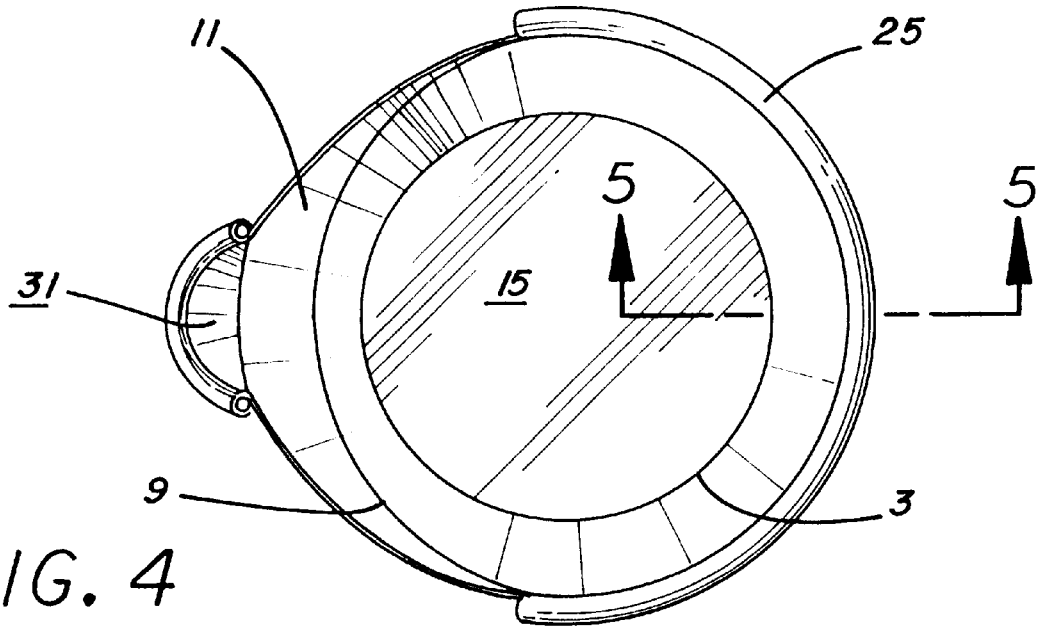
FIG. 4 is a top view of the device of the present invention.

As illustrated in FIGS. 1 through 3, an arcuate crease is formed on a portion of body 7 and preferably on an upper portion of body 7. One of the functions of crease 9 is to allow hinged movement of lid 11 about the axis defined by crease 9. Accordingly, lid 11 can move back and forth from a closed, concave shaped position to an open, convex shaped position having a pivot line along crease 9. As explained above, the materials forming device 1 and particularly its body 7, employ elastic or resilient, deforming qualities that allow lid 11 to move back and forth along crease 9 without separating or lacerating it or body 7.

Figure 7:
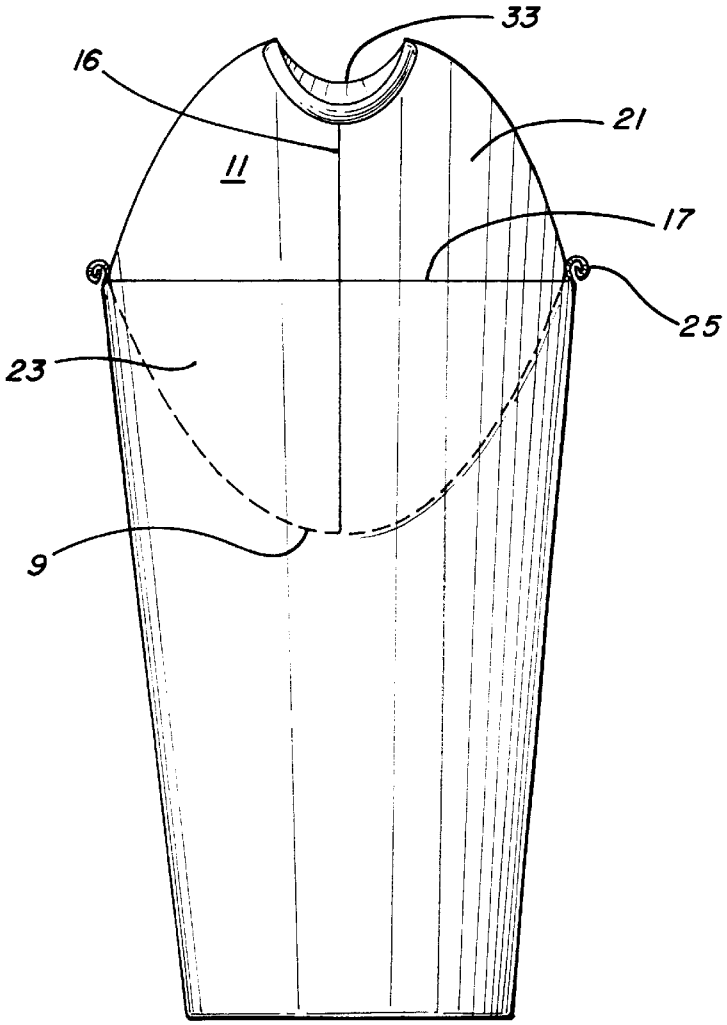
FIG. 7 is a top view of the lid of the present invention.
Figure 6:
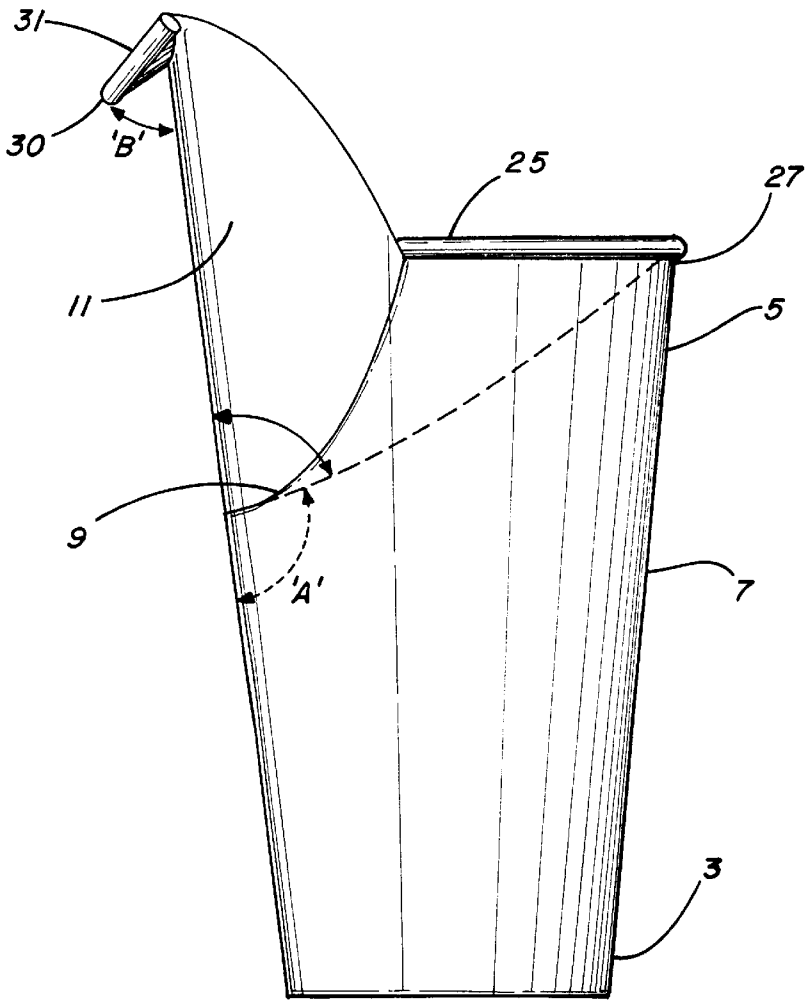
FIG. 6 is a side view of the device of the present invention.

Lid 11 is integral to body 7. Its shape and size are defined by arcuate crease 9 on the lower portion 23 thereof and of its upper portion 21. First and second axis 16 and 17, respectively, corresponding to the first and second diameters of lid 11, are shown in FIG. 7. In the preferred embodiment, first axis 16 is slightly longer than second axis 17 thereby providing lid 11 with a symmetrical, oval shape. Moreover, lid 11 can be described having integral upper and lower portions 21 and 23, respectively, joined at axis 17. Upper and lower portions' distal ends 21 and 23 are diametrically opposed and their respective distal edges lie at opposite ends of axis 16. Arcuate crease 9 defines the hinged edges of the lower portion 23 of lid 11 and is formed between top portion 5 and bottom portion 3, integral to body 7. A rim 25 is integrally formed at marginal ends of top portion 5. Rim 25 has an annular, disjointed perimeter (i.e. the perimeter of rim 25 is interrupted by lid 11) and accepts lid 11 thereunder. The perimeter of rim 25 is continuous from distal ends of axis 17, which perimeter and lid 11 together define a 360-degree sealed circumference, matching the perimeter of the top portion 5.

Figure 5:
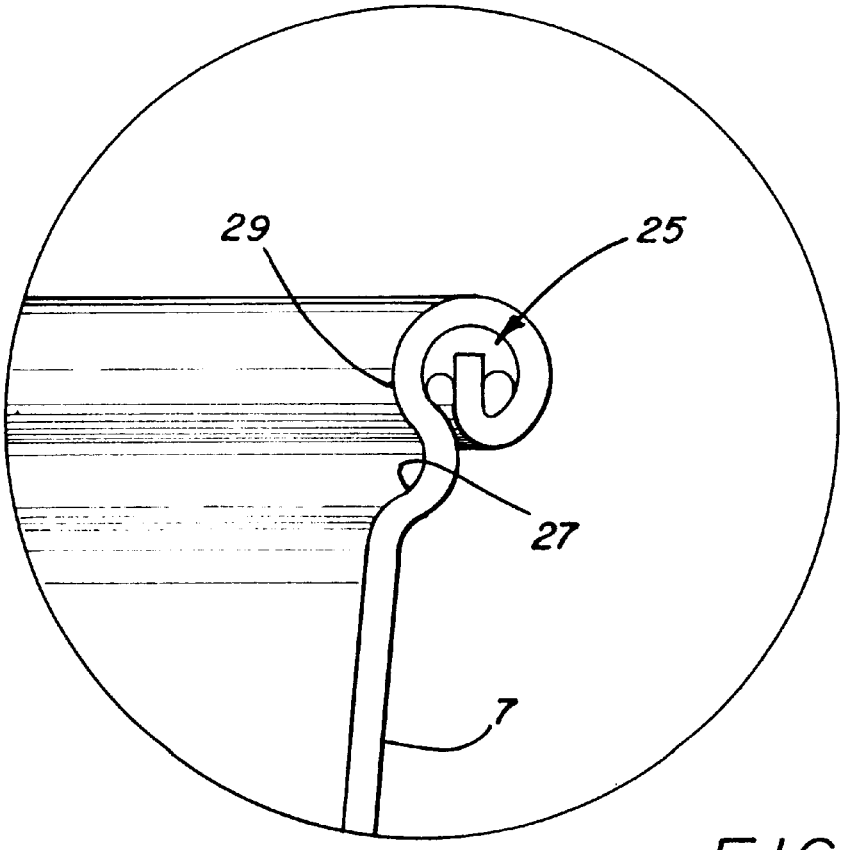
FIG. 5 is a side-expanded view of the area A-A identified in FIG. 4, representing one embodiment of the ridge of the top portion of the device of the present invention.

The shape of upper portion 21 of lid 11 is matched to the perimeter of rim 25. This allows lid 11 to hingedly move toward rim 25 along crease 9 and to enclose the contents placed in device 1. Because the materials comprising device 1 have resilient and elastic qualities, lid 11 can hingedly move, without lacerating crease 9. As lid 11 moves toward rim 25 and comes in position therewith, respective marginal edges along its upper portion 21 and rim 25, come into juxtapositional contact along the perimeter of rim 25. The crossection of rim 25 and an integral ridge 27, formed parallel along rim 25, are illustrated in FIG. 5. In the preferred embodiment, rim 25 has an annular circumference inwardly tapering the marginal edges of top portion 5 at stop 29; and ridge 27 provides for a continuous parallel channel along rim 25. Stop 29 is used as a seal or lock accepting and retaining lid 11 within ridge 27, when said lid 11 is in its closed position. Regardless of the shape of any element of device 1 and specifically lid 11 and ridge 27, when lid 11 is accepted and retained in ridge 27, in combination these elements prevent leaking of the contents past ridge 27 and lid 11. When lid 11 is in its closed position it may be deformed to assume a concave shape. In combination, applying the deforming and elastic qualities of materials that make up device 1, rim 25 and lid 11, these components deform under pressure supplied by the user as he/she forces lid 11 against stop 29. As the pressure is applied, lid 11 passes by stop 29 and comes to a rest along ridge 27, below rim 25 and stop 29, wherein it remains until such time as lid 11 is forced in the opposite direction against and past stop 29 to assume its open position.

In the preferred embodiment, lid 11, in its closed position, extends in an upward slope from crease 9 to engage rim 25. Therefore, lid 11 has an obtuse angle 'A' (i.e. greater than ninety-degrees) relationship with body 7, upwardly inclining into closure with rim 25 and ridge 27.

As disclosed herein the device of the present invention can be utilized in a plurality of applications. One such application is the dispensing of solid objects such as salt, rice or sugar. One can dispense such items when lid 11 is in its open position functioning as a spout. In the alternative, one can also construct lid 11 with at least one or multiple apertures therein so that the contents are dispensed at a particular rate and/or flow. As an example, if device 1 is used to dispense table salt, small apertures can be placed along some or all of lid 11 so that the salt granules fall through the apertures when device 1 is tilted. Different size apertures can be used depending on the application to allow more or less of the contents to pass therethrough.

Figure 10:
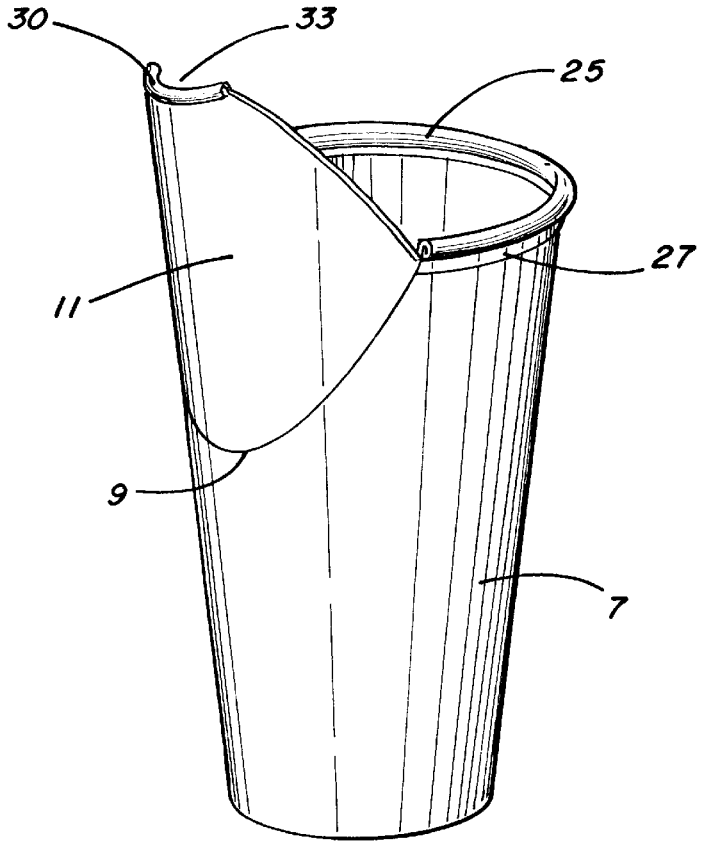
FIG. 10 illustrates the perspective view of the device of the present invention having an aperture and a dispensing rim.
Figure 11:
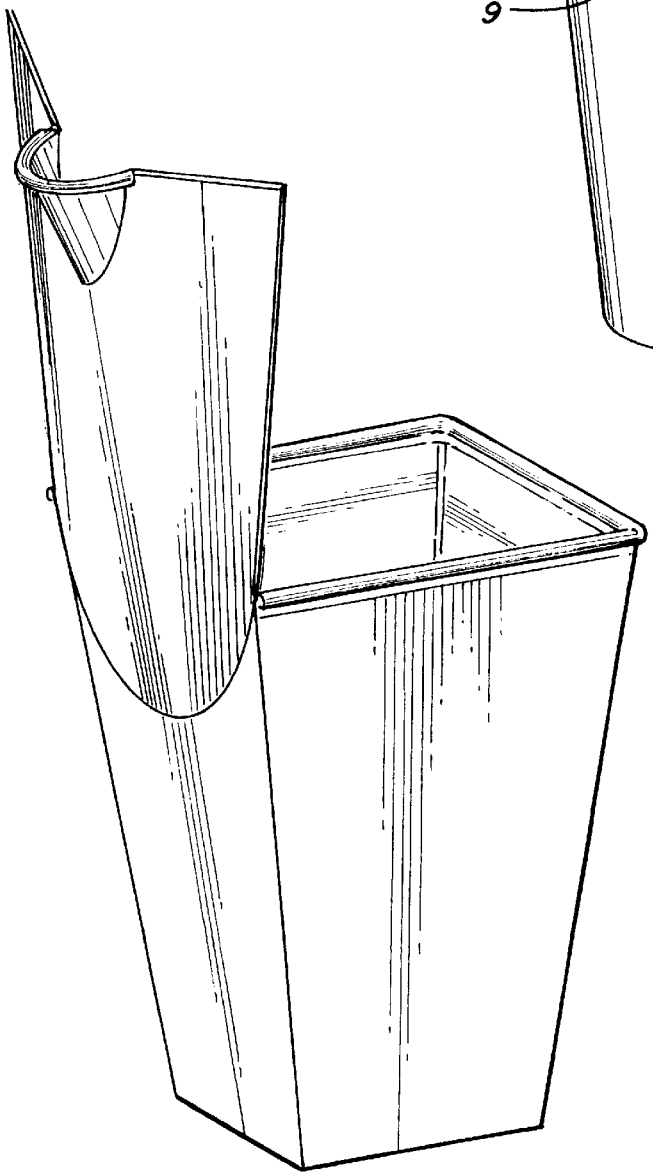
FIG. 11 illustrates a perspective view of the device having a rectangular shape with the lid in the open position.

In another embodiment, lid 11 is formed with an aperture 33 formed congruent to and/or amid the marginal edges of upper portion 21 of lid 11. When lid 11 is in the closed position, aperture 33 provides a passage for dispensing the contents within device 1. In the preferred embodiment, as shown in FIG. 10, a dispensing rim 30 is formed congruent to said aperture 33. If device 1 is used as a cup, aperture 29 allows the beverage or the liquid to leave device 1 when it is tilted. Therefore, a user can tilt device 1 to his/her mouth and sip the liquid, such as hot coffee, while lid 11 is closed.

The device of the preferred embodiment may employ a lip 31 in addition to dispensing rim 30. lip 31 serves two basic functions. First, when lid 11 is in the closed position, it allows the user to rest his/her upper lip against lip 31 to prevent an accidental burning of his/her upper lip. Without lip 31, user's lip may touch lid 11 while it is in contact with the hot liquid. Depending on the heat transfer characteristics of the materials making up device 1, the heat transferred through the material may burn the user's lip when device one contains hot beverages. Because lip 31 is angled away from and forms an acute angle 'B' (i.e. less than ninety-degrees) with lid 11, there is an air buffer between lip 31 and lid 11. This buffer acts as an insulator that does not allow the transfer of heat from the hot liquid through lid 11 to lip 31.

Therefore, the user can tilt device 1 and sip a hot beverage without burning his/her lip.

Second basic function of lip 31 in combination with aperture 29 is to serve as a spout and/or guide when lid 11 is in the open position. When a user uses device 1 as a cup and drinks a beverage with lid 11 in the open position, he/she employs aperture 29 and lip 31 as a guide for dispensing the beverage. Moreover, lip 31 strengthens the integrity of aperture 29. Without lip 31, the marginal edges of aperture 29 may become weak with use as the user's lips, teeth and saliva may soften or deform the materials making up device 1. The crossection of dispensing rim 30, in the preferred embodiment, is substantially equivalent to the crossection of rim 25 shown in FIG. 5.

In another embodiment (not shown) a perforated aperture is formed in lid 11 allowing the user to tear away a flap thereby providing the user with access to the contents of device 1. In this embodiment, the device may be used for mixing an instant beverage or food, e.g. dry mixes which require addition of a hot or cold liquid, for example, including, but not restricted to, instant soup, instant hot cereal or other instant mixtures. Yet in another embodiment (not shown) a perforated aperture and/or slits are formed in lid 11 for insertion of a utensil or tool such as a drinking straw, fork or spoon therethrough. Finally, in other embodiments of the present invention no aperture is found in lid 11.

It should be noted that the volume of contents contained in device 1 in part depends on the circumference of top and bottom portions 5 and 3. This relationship is true because the circumference of arcuate crease 9 is directly dependent on the circumference of the top portion 5 and its rim 25. Accordingly, the circumference of crease 9 will decrease as the circumference of the opening defined by rim 25 and second axis 17 decreases. As the circumference of crease 9 decreases, crease 9 position move closer to top portion 5, thereby increasing volume within device 1.

While the invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A container having an integral lid, the container comprising:

a) a body formed between diametrically disposed top and bottom portions;

b) a rim congruent to said top portion forming a seal for an integral lid;

c) said lid having a lower portion having a hinged edge, and an upper portion having an upper edge shaped to match said rim, at least one aperture formed in said lid to facilitate the dispensing of the contents from said container;

d) a crease formed in said body defining said hinged edge of said lower portion of said lid, said lid and said body integrally joined at said crease, said crease dimensioned allowing said lid to continuously hinge toward said rim, substantially sealing said container and retaining a closed position about said rim when biased into said closed position.

2. The container of claim 1 wherein said lid is upwardly sloped to its closed position from said crease.

3. The container of claim 1 further comprising a ridge formed parallel with said rim for accepting and retaining said lid therein.

4. The container of claim 1 wherein said body is tapered at its bottom portion to facilitate efficient nesting of a plurality of said containers, storage and handling of said containers.

5. The container of claim 1 wherein said body is selected from a group of three-hundred-sixty degree circular, oval, oblong, rectangular, polygonal, and annular cross sections.

6. The container of claim 1 wherein said lid is alternatively positional along said crease in said closed position, by biasing said lid past a stop formed by an inner circumference of said rim and retained along a ridge formed continuous with said rim, said ridge having a larger circumference than said circumference of said stop and substantially matching a circumference of said lid; and an open position, by moving said lid out of said ridge and past said stop to a substantially linear position with said body thereby forming a spout.

7. The container of claim 1 wherein said aperture is formed in the upper edge of said lid.

8. The container of claim 1 further comprising a dispensing rim congruent to said aperture.

9. The container of claim 1 further comprising a lip congruent to said aperture.

10. The container of claim 1 further comprising at least one perforation formed in said lid for forming said at least one aperture.

11. The container of claim 1 wherein said container is constructed of deformable material.

12. The container of claim 11, wherein said deformable material is resilient.

13. The container of claim 11, wherein said deformable material is selected from at least one of the group consisting of cardboard, plastic, polypropylene and styrofoam.

14. A container having an integral lid, the container comprising:

a) a body formed between diametrically disposed top and bottom portions; a rim congruent to said top portion forming a seal for an integral lid;

b) said lid having a lower portion having a hinged edge, and an upper portion having an upper edge shaped to match said rim, at least one aperture formed in said lid to facilitate the dispensing of the contents from said container;

c) a crease formed in said body defining said hinged edge of said lower portion of said lid, said lid and said body integrally joined at said crease, said crease dimensioned allowing said lid to continuously hinge toward said rim and assume a concave shape, substantially sealing said container and retaining a closed position about said rim when biased into said closed position.

15. The container of claim 14 wherein said lid is upwardly sloped to its closed position from said crease.

16. The container of claim 14 wherein said lid is alternatively positional along said crease in said closed position, wherein in said closed position said lid assumes a concave shape, by biasing said lid past a stop formed by an inner circumference of said rim and retained along a ridge formed continuous with said rim, said ridge having a larger circumference than said circumference of said stop and substantially matching a circumference of said lid; and an open position, wherein in said open position said lid assumes a convex shape, by moving said lid out of said ridge and past said stop to a substantially linear position with said body thereby forming a spout.

* * * * *